US005755167A

United States Patent [19]

Ciucani

[11] Patent Number: 5,755,167

[45] Date of Patent: May 26, 1998

[54] DEVICE FOR DECORATIVE SEWING OF DIFFERENT KINDS OF ARTICLES, ESPECIALLY ARTICLES MADE OF LEATHER

[76] Inventor: Mario Ciucani, Via S. Girolamo, Fermo, Italy

[21] Appl. No.: 849,020

[22] PCT Filed: Dec. 18, 1995

[86] PCT No.: PCT/IB95/01137

§ 371 Date: May 27, 1997

§ 102(e) Date: May 27, 1997

[87] PCT Pub. No.: WO96/20305

PCT Pub. Date: Jul. 4, 1996

[30] Foreign Application Priority Data

Dec. 23, 1994 [IT] Italy ..... MC940032 U

[51] Int. Cl.[6] ..... D05B 15/02; D05B 27/20; D05B 35/10

[52] U.S. Cl. ..... 112/49; 112/62; 112/310; 112/321; 112/153

[58] Field of Search ..... 112/49, 50, 51, 112/60, 62, 61, 28, 47, 63, 136, 310, 321, 153, 235; 12/146 C, 123, 13.2

[56] References Cited

U.S. PATENT DOCUMENTS

| | | | |
|---|---|---|---|
| 2,235,753 | 3/1941 | Waterman . | |
| 2,399,159 | 4/1946 | Ashworth | 112/62 |
| 3,081,719 | 3/1963 | Fake . | |
| 4,848,252 | 7/1989 | Ciucani . | |
| 5,207,169 | 5/1993 | Ciucani | 112/49 |

*Primary Examiner*—Peter Nerbun

*Attorney, Agent, or Firm*—McAulay Fisher Nissen Goldberg & Kiel, LLP

[57] ABSTRACT

A device for decorative sewing of articles made of leather includes a longitudinal guide (7) a part of which is laterally delimited by two inclined flat surfaces (*7a*, *7b*) upwardly convergent, forming at the top a tooth (10) on which an article (1) to be sewn is moved. A folding member (12), situated over the longitudinal guide (7), clamps the article (1) to the tooth (10), by folding this article (1) on the inclined flat surfaces (*7a*, *7b*), when the needle (20) has formed a stitch (4). A leather pressing element (15) oscillates on a plane that is transversal with respect to the longitudinal guide (7) and presses the article (1) in position adjacent to the stitch 4 just formed, on the side where the needle (20) enters the article (1).

5 Claims, 5 Drawing Sheets

DEVICE FOR DECORATIVE SEWING OF DIFFERENT KINDS OF ARTICLES, ESPECIALLY ARTICLES MADE OF LEATHER

TECHNICAL FIELD

The present invention relates to sewing leather articles or the like, in particular for footwear production.

BACKGROUND ART

Known automatic machines for sewing leather articles, like e.g. a toe cap and a vamp of a shoe, usually feature a head, cantilevered on the front of a base structure and equipped with means supporting the needle and related operating means.

The needle is moved toward an arm, situated below, that acts as a horizontal support, on which the leather articles to be sewn rest.

The needle moves also in direction parallel to the support arm. The above mentioned machines are equipped also with transport means that move the edges of the leather articles to be sewn after each stitch.

A machine of this type is disclosed in the U.S. Pat. No. 4,848,252 of the same Applicant. This machine includes a guide that longitudinally defines two flat inclined surfaces, upwardly convergent, that form respective work tops, on which the leather articles to be sewn are moved.

Over the guide, there is a longitudinal shaft, with an arm keyed thereto and provided at its free extremity with a curved needle.

The shaft is oscillated so as to alternatively move the needle between a raised position and a lowered position, in order to pierce the edges of the leather articles.

The needle operates in combination with a crochet with a thread. The above mentioned machine is designed to sew edges of shoe uppers and toe caps of any shape.

However, this machine cannot be used for decorative stitches, such as, in particular, shoe upper ribs obtained by sewing.

FIG. 1 shows, as an example, a shoe upper 1 with a rib 2 that runs along the outline of a toe cap 3; the rib 2 is obtained by stitches 4.

This kind of decorative stitch not only imitates the joining of two different parts, i.e. the shoe upper and toe cap, sewn together, that in fact are instead made from one piece of leather, but also stiffens the shoe in order to shape it in a desired way.

At present, the above mentioned decorative stitching is hand-made, that requires a specialised staff thus increasing manpower cost and subsequently, the final cost of the product, and moreover, the throughput is reduced.

DISCLOSURE OF THE INVENTION

The object of the present invention is to provide an automatic device designed to perform decorative stitches on leather articles, particularly ribs on a shoe upper.

The above mentioned object is obtained by means of a device for sewing articles made of leather that includes a longitudinal guide, a part of which is laterally delimited by two inclined flat surfaces upwardly convergent, forming at the top a tooth on which an article to be sewn is moved, a folding member that is situated over said longitudinal guide for clamping said article to the tooth, by folding this article on the inclined flat surfaces, when a needle has formed a stitch, and a leather pressing element, that presses the article in position adjacent to the stitch that has just been formed, and situated on a plane that is transversal with respect to the longitudinal guide, on the side where the needle enters the article.

BRIEF DESCRIPTION OF THE DRAWINGS

The characteristic features of the present invention are pointed out in the following description with reference to the enclosed drawings, in which.

BEST MODE OF CARRYING OUT THE INVENTION

Figure 1:
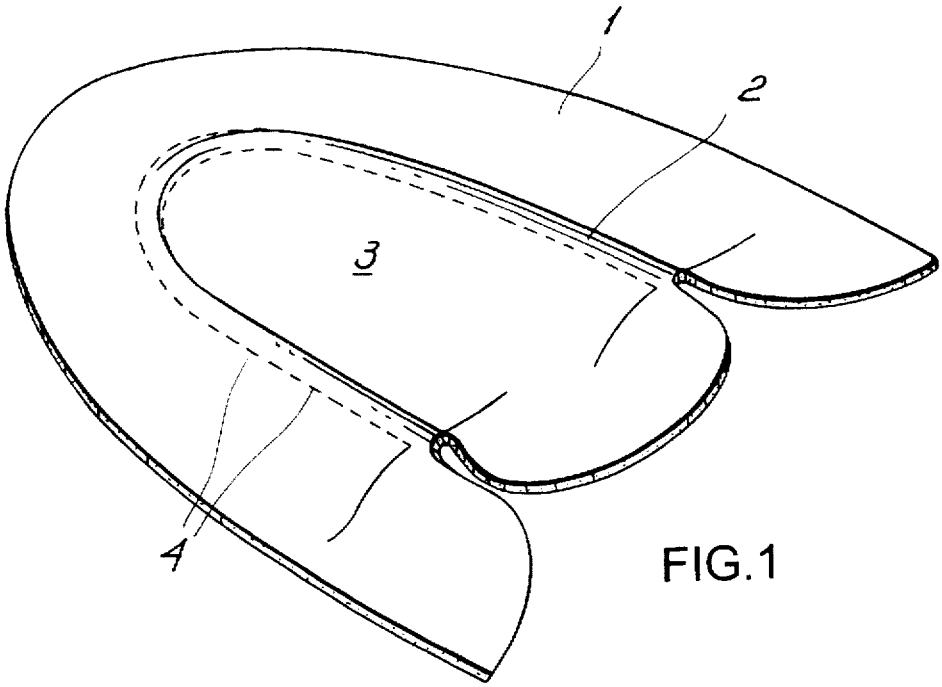
FIG. 1 is a perspective view of a shoe upper with a decorative rib.

Referring to the drawings, reference numeral 5 indicates the device mounted on the sewing machine 6, in order to perform a decorative stitch on a leather article 1, constituted by a shoe upper.

The device 5 has a longitudinal guide 7, fitted to a column 8, which rises from an arm 9, integral with the support structure of the sewing machine; the arm 9 is a straight extension of the front surface of the machine structure.

A part of the guide 7, is laterally delimited by inclined flat surfaces 7*a*, 7*b*, upwardly convergent. The inclined surfaces 7*a*, 7*b* form respective work tops, on which leather article to be sewn 1 is folded and moved stepwise.

At its top, the guide 7 features a tooth 10, with a longitudinal rib 11 made in its lower part. The tooth 10 and a longitudinal rib 11 are connected by a semicircular profile so that the top of the tooth overlaps the region where a needle 20 pierces the article 1.

The upper part of the leather article 1 rests on the tooth 10, astride thereof. A folding member 12, situated vertically over the tooth 10, acts on the leather article 1 by a shaped head 13 defining a recess 14 directed downwards.

A leather pressing element 15 is formed at the free extremity of an arm 16, that oscillates on a plane transversal to the longitudinal guide 7. The leather pressing element 15 is situated before the stitching zone and operates in combination with the folding member 12, so as to press the leather article 1 in position adjacent to the just formed stitch 4.

In its lower part, the leather pressing element 15 features an oblong extension 17, in a form of a cylinder, oriented according to an axis parallel to a longitudinal axis of the guide 7.

The extension 17 is designed to hold down the leather article 1 in order to prevent it from rising, when the needle 20 goes out.

The leather pressing element 15 has also a slot 18 through which the needle 20 passes. The sewing machine has a shaft that is longitudinally oriented and equipped with a transversal arm 19, to which extremity a curved needle 20, coaxial with the same shaft, is tangentially mounted.

The needle 20 oscillates between a raised position, beside the work top *7b* of the guide 7, and a lowered position, in which the needle 20 passes through the leather article to be sewn 1.

The needle 20 oscillates in a suitable phase relation with the movement of the leather article to be sewn.

It is to be pointed out that the needle 20 can oscillate due to the lowering defined by the rib 11 before the tooth 10. The shaft of the needle 20 is reciprocated axially, in suitable phase relation with the movement of the leather article to be sewn.

A crochet 21, with a thread bobbin, is aimed at working in conjunction with the needle 20. The crochet 21 is situated beside the work top *7a* of the guide 7.

The operation of the machine will now be illustrated beginning from a step before a stitch is performed. In this step, the shoe upper 1 is situated on the longitudinal guide 7 and folded on it by the shaped head 13 of the folding member 12.

In fact, the vamp 1 is clamped between the tooth 10 of the guide 7 and the recess 14 of the folding member 12 and its edges are folded downwards, on the opposite sides of the guide 7, following the inclined surfaces *7a, 7b*, of the same guide.

Figure 5:
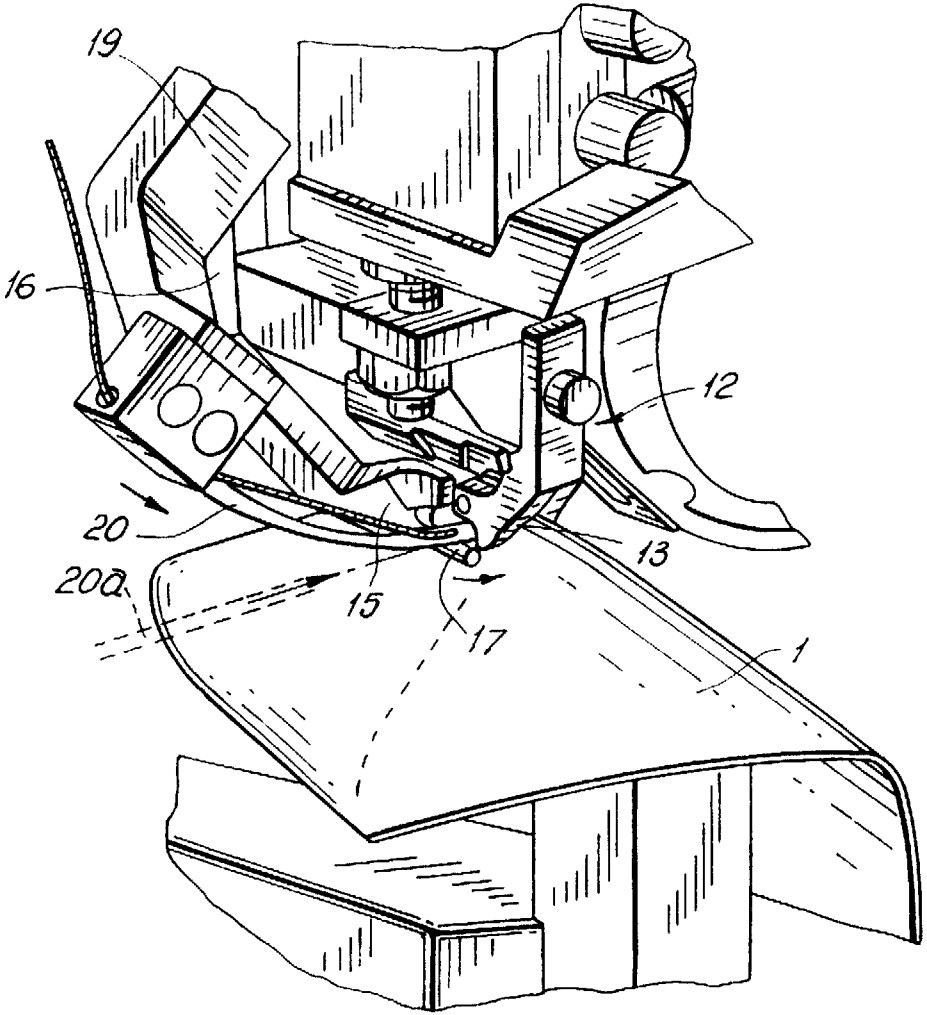
FIGS. 5, 6, and 7 are views of different working steps of the device shown in FIG. 3.
Figure 4:
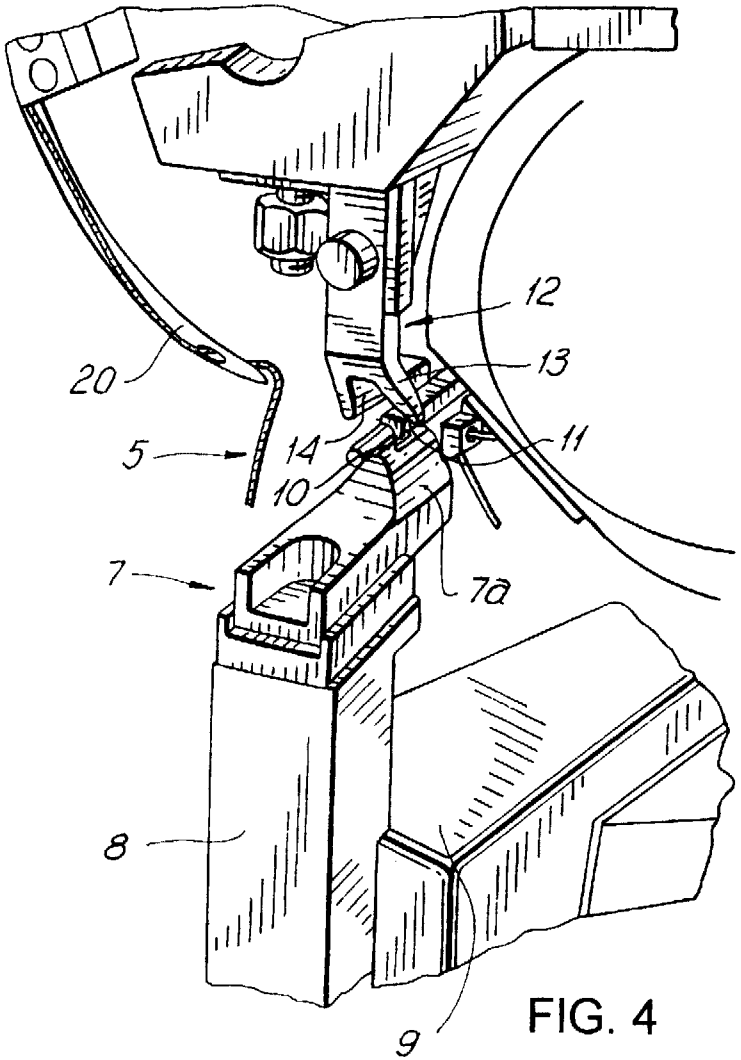
FIG. 4 is another perspective view of the stitching device, seen from a different point of view.

Now, the leather pressing element 15 is oscillated on a plane transversal to the longitudinal guide 7 and the extension 17 clamps the vamp 1 to the guide 7 (see FIG. 5).

In this configuration, the needle 20 goes down and, in cooperation with the crochet 21, performs a stitch 4 on the folded part of the vamp 1 (see again FIG. 5).

In fact, the needle 20, following a circular trajectory, passes through the edges of the vamp 1, folded on the tooth 10 of the longitudinal guide 7.

After having passed through the edges of the vamp 1, the needle 20 is carried to the working zone of the crochet 21; in known way, the loop made by the thread of the needle 20 is hooked, due to the oscillation of the crochet 21.

Figure 6:
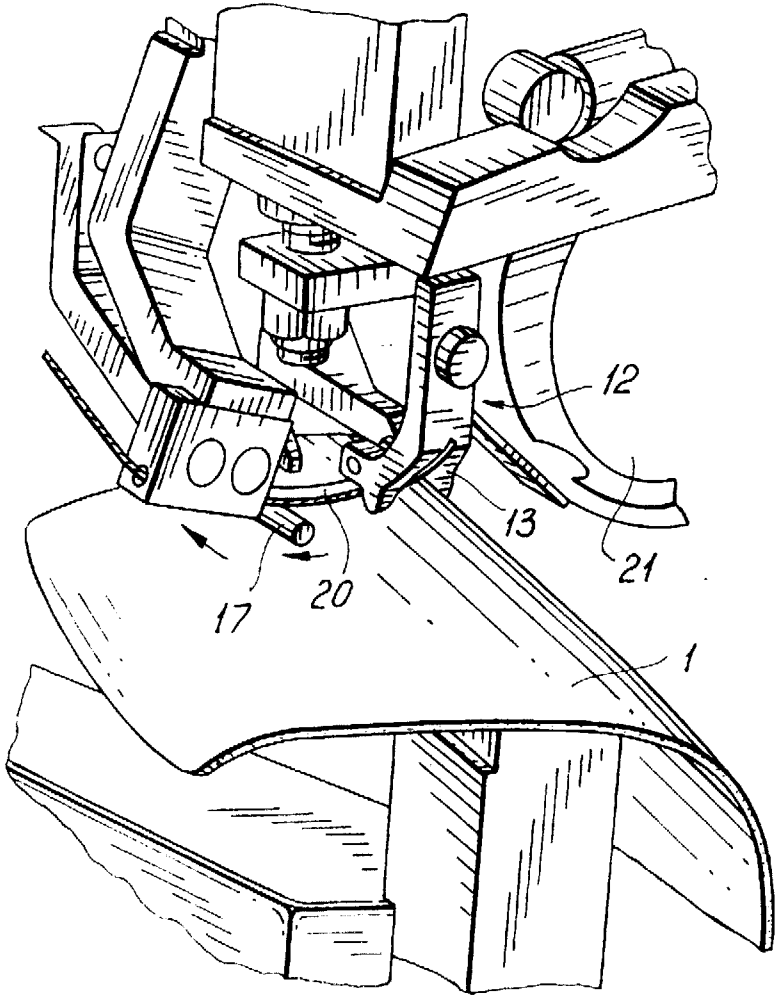

Then, the leather pressing element 15 is raised, so that the vamp 1 can move forward along the guide 7 (FIG. 6).

This movement of the shoe upper 1, imposed by known and not illustrated means, is synchronous with the longitudinal translation of the needle 20 in the same direction.

Figure 7:
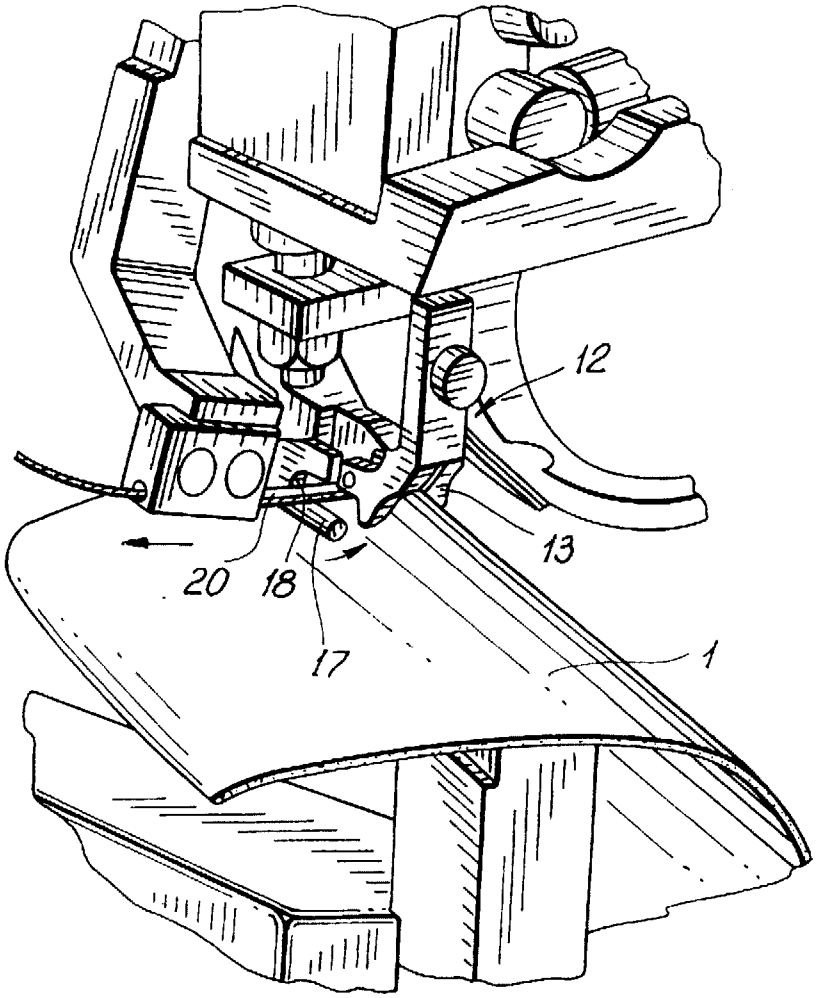

When the longitudinal translation has been completed, the leather pressing element 15 is imparted an oscillation on a plane transversal to the longitudinal guide 7, and its extension 17 clamps the vamp 1 to the guide, in a position adjacent to the stitch 4 that has just been made (see FIG. 7).

This allows to keep the stitching zone of the upper 1, when the needle 20 rises, so that the thread hooked by the crochet 21 forms the above mentioned loop.

At this point, the needle 20 together with the crochet 21 are longitudinally translated in the direction opposite to the movement direction of the shoe upper, so that the initial conditions are restored, in order to perform next stitch.

The stitches 4 form a decorative rib 2 on the shoe upper 1, like the one illustrated in FIG. 1.

Figure 10:
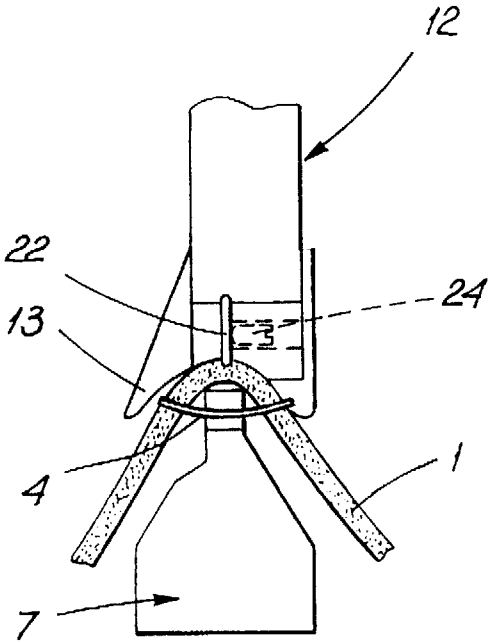
FIG. 10 is a corresponding transversal section of the same particular shown in FIG. 9.
Figure 9:
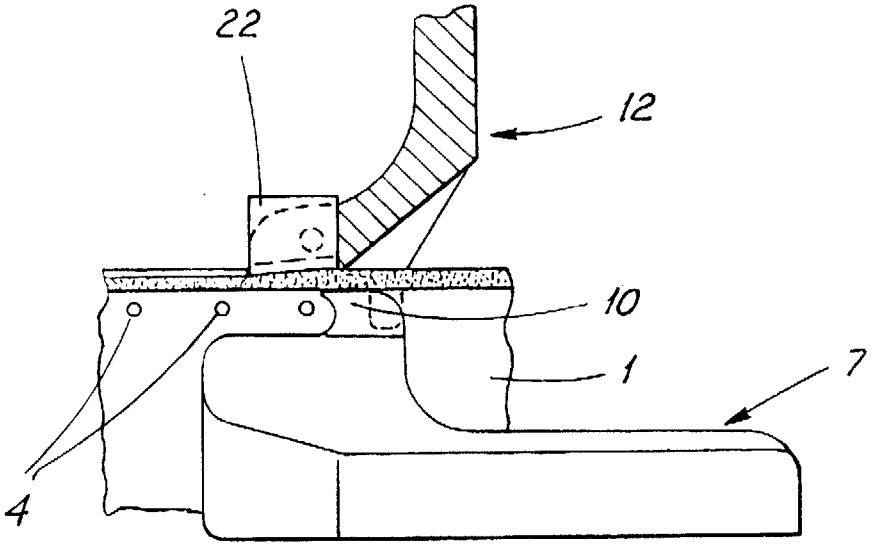
FIG. 9 is a longitudinal section view of a particular of the subject device, suitably equipped for performing the decorative stitch of FIG. 8.

FIGS. 9 and 10 illustrate a different embodiment of the invention, in which the folding member 12 of the stitching device 5 can be equipped with a blade 22 situated on a vertical plane, longitudinal with respect to the guide 7.

The blade 22 enters a correspondent slot 23 made in a front part of the head 13 of the folding member and is locked therein by a transversal dowel 24, screwed in a suitable threaded seat of the same head 13.

Figure 8:
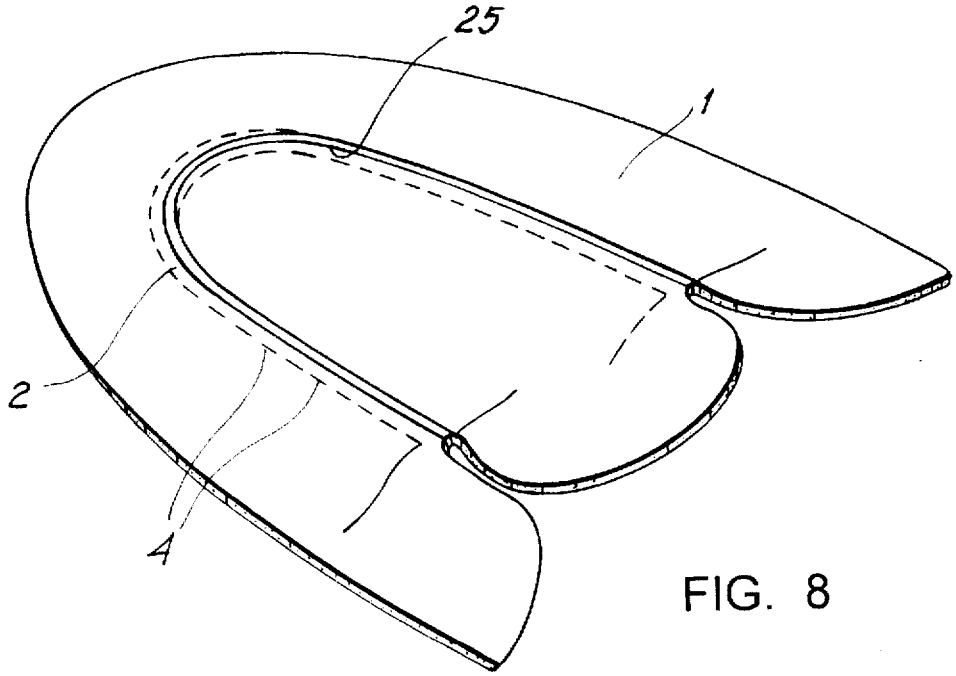
FIG. 8 is a perspective view of a shoe upper featuring a different embodiment of decorative stitch.
Figure 3:
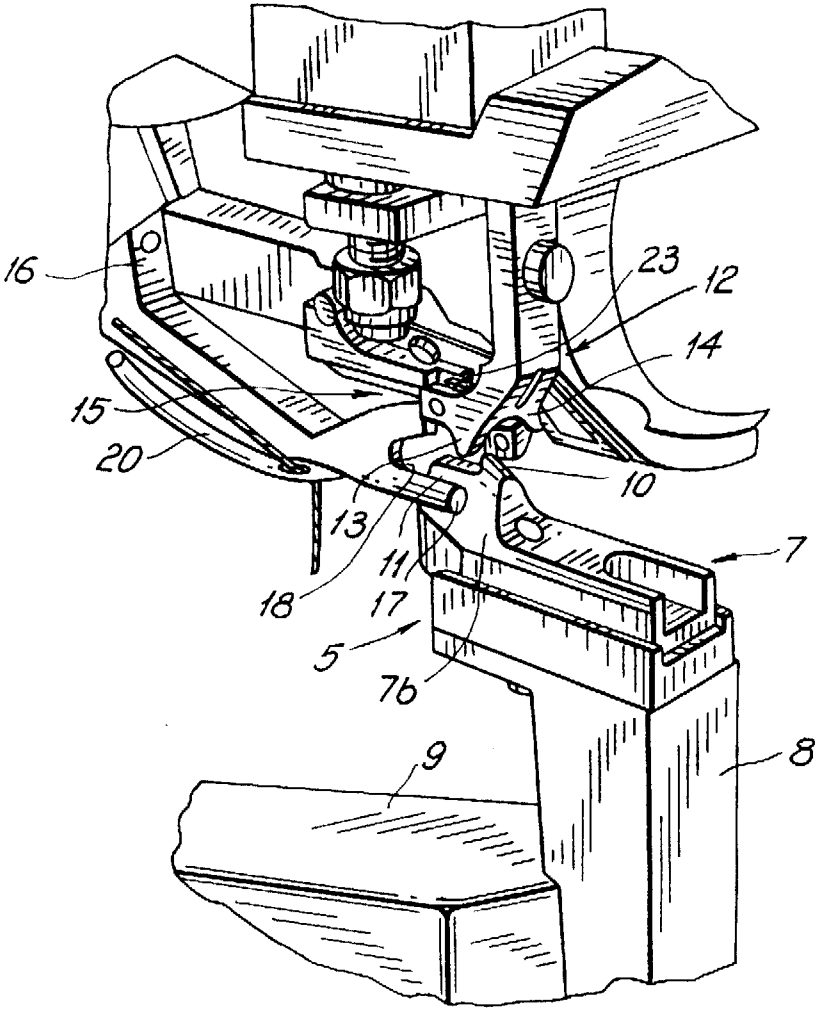
FIG. 3 is a detailed perspective view of the said stitching device.
Figure 2:
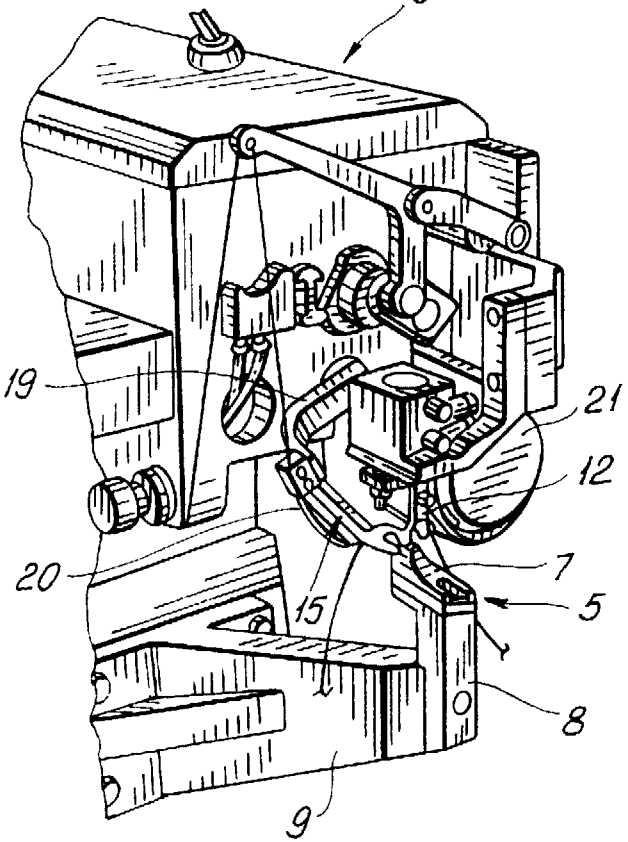
FIG. 2 is a perspective view of the stitching device, being the subject of the present invention, mounted on the sewing machine.

The blade 22 features a lower cutting edge that, when the shoe upper 1 moves, makes a cut 25 along the crest of the rib 2, as shown in FIG. 8.

The cut 25 is ornamental and imitates a separation line between two different pieces of leather, joined together by the stitch 4.

It is evident that the described device is simple and allows to automatically perform decorative stitches on leather articles, particularly ribs along the shoe upper.

In particular, the device can be applied to the known sewing machines of the same type. The device can also use a straight needle instead of the curved one, that acts in horizontal direction, as shown with the broken line 20*a* in FIG. 5.

I claim:

1. A device for decorative sewing articles made of leather, this device including:

a longitudinal guide (7), a part of which is laterally delimited by two inclined flat surfaces (*7a, 7b*), upwardly convergent, on which an article (1) to be sewn is moved;

a folding member (12) that is situated over said longitudinal guide (7) for clamping said article (1) to the longitudinal guide by folding this article (1) on the inclined flat surfaces (*7a, 7b*), when a needle (20) has formed a stitch (4);

a leather pressing element (15), that presses said article (1) in position adjacent to the stitch (4) that has just been formed, and situated on a plane that is transversal with respect to the longitudinal guide (7), on the side where the needle (20) enters said article (1);

said device being characterized in that said longitudinal guide (7) at the top of said two inclined, upwardly convergent, flat surfaces (*7a, 7b*) features a tooth (10) projecting upward and a longitudinal rib (11) located behind said tooth (10) of said guide (7) at a level lower than said tooth (10), said tooth being connected to a said longitudinal rib (11) by a semicircular profile so that the top of said tooth overlays the region where said needle (20) pierces said article (1).

2. A device, according to claim 1, characterized in that said folding member (12) pushes said leather article (1) through a shaped head (13) that defines a recess (14) directed downwards.

3. A device, according to claim 1, characterized in that said folding member (12) features a vertical blade (22) that extends longitudinal with respect to said guide (7), so that a lower cutting edge of said blade makes a cut (25) along the crest of the rib (2) defined by the stitches (4) on said article (1) as the article (1) moves.

4. A device, according to claim 1, characterized in that in its lower part, said leather pressing element (15) features an oblong extension (17), oriented in a longitudinal direction with respect to the guide (7), and designed to hold the leather article (1) and to prevent it from rising, when the needle (20) goes out.

5. A device, according to claim 1, in that said longitudinal guide (7) is fitted to a column (8), which rises from an arm (9) that is a straight extension of a front surface of said sewing machine (6).

* * * * *